US009467788B2

(12) United States Patent
Lommel et al.

(10) Patent No.: US 9,467,788 B2
(45) Date of Patent: Oct. 11, 2016

(54) HEARING DEVICE WITH A FRAME HOLDING HEARING DEVICE COMPONENTS AND A SHELL ENCASING THE FRAME

(75) Inventors: Dietmar Lommel, Poxdorf (DE); Josef Ruppert, Kleinsendelbach (DE)

(73) Assignee: Sivantos GmbH, Erlangen (DE)

( * ) Notice: Subject to any disclaimer, the term of this patent is extended or adjusted under 35 U.S.C. 154(b) by 1488 days.

(21) Appl. No.: 12/072,845

(22) Filed: Feb. 28, 2008

(65) Prior Publication Data

US 2008/0212817 A1 Sep. 4, 2008

(30) Foreign Application Priority Data

Mar. 1, 2007 (DE) ..... 10 2007 010 014

(51) Int. Cl.
*H04R 25/00* (2006.01)

(52) U.S. Cl.
CPC ..... *H04R 25/608* (2013.01)

(58) Field of Classification Search
USPC ..... 381/322
See application file for complete search history.

(56) References Cited

U.S. PATENT DOCUMENTS

| | | | | | |
|---|---|---|---|---|---|
| 3,239,093 | A * | 3/1966 | Gath | H04R 25/652 | 220/4.02 |
| 4,739,512 | A * | 4/1988 | Hartl et al. | 381/328 | |
| 4,870,688 | A * | 9/1989 | Voroba et al. | 381/60 | |
| 5,204,917 | A * | 4/1993 | Arndt | H04R 25/608 | 381/324 |
| 5,708,720 | A * | 1/1998 | Meyer | H04R 25/00 | 174/363 |
| 5,748,743 | A * | 5/1998 | Weeks | 381/328 | |
| 6,522,764 | B1 * | 2/2003 | Bøgeskov-Jensen | 381/330 | |
| 6,597,793 | B1 * | 7/2003 | Darbut et al. | 381/313 | |
| 7,403,629 | B1 * | 7/2008 | Aceti et al. | 381/324 | |
| 2004/0120539 | A1 * | 6/2004 | Panitzsch | 381/312 | |
| 2004/0196996 | A1 * | 10/2004 | Feitel | 381/322 | |
| 2005/0238192 | A1 * | 10/2005 | Ford | H04R 25/654 | 381/322 |
| 2006/0034474 | A1 * | 2/2006 | Topholm | H04R 25/556 | 381/322 |
| 2007/0071265 | A1 * | 3/2007 | Leedom | H04R 25/608 | 381/322 |
| 2007/0110270 | A1 * | 5/2007 | Tipsmark et al. | 381/374 | |

FOREIGN PATENT DOCUMENTS

| | | | |
|---|---|---|---|
| DE | 7831808 | U1 | 4/1980 |
| DE | 42 30 308 | C1 | 5/1993 |
| DE | 4230308 | C1 | 5/1993 |
| DE | 202004019744 | U1 | 3/2005 |
| EP | 1 715 722 | A2 | 10/2006 |
| WO | 2006067133 | A1 | 6/2006 |

* cited by examiner

*Primary Examiner* — Christopher Uhlir
(74) *Attorney, Agent, or Firm* — Laurence A. Greenberg; Werner H. Stemer; Ralph E. Locher

(57) ABSTRACT

A frame is provided for the hearing device, which frame is constructed in such a way that it holds all of the internal components. The shells or the battery compartment are secured to the frame. Thereby, a conversion of a hearing device by the ordinary acoustician is possible.

2 Claims, 3 Drawing Sheets

HEARING DEVICE WITH A FRAME HOLDING HEARING DEVICE COMPONENTS AND A SHELL ENCASING THE FRAME

CROSS REFERENCE TO RELATED APPLICATIONS

This application claims priority of German application No. 102007010014.2 DE filed Mar. 1, 2007, which is incorporated by reference herein in its entirety.

FIELD OF INVENTION

The present invention relates to a structure of a hearing device.

BACKGROUND OF INVENTION

Because the electronic or, as the case may be, electromechanical components were held in the shells, the conversion is relatively time-consuming and can only be carried out by professionally trained personnel. A test of the functionality and/or stability (acoustics) was necessary in every case.

SUMMARY OF INVENTION

The conversion of a hearing device by the ordinary acoustician was not possible in the prior art. Only a small number of company chains were able to perform this conversion.

According to the invention the frame is constructed in such a way that it holds all of the internal components. This basic frame structure, which, together with the internal components, is referred to as the basic structure or basic device, is color-neutral. The shells or, as the case may be, the battery compartment are secured to the frame, e.g. by means of pins.

In addition to the improved conversion capability of the hearing device, the neutral basic device also leads logistically to simplification, since shells or battery compartments can be combined with less frequently required colors only at the customer's request. Even the acoustician can put together different color combinations at the customer's request. A full functional test is thereupon no longer necessary.

BRIEF DESCRIPTION OF THE DRAWINGS

An exemplary embodiment of the invention is explained in more detail below with reference to the drawing, which comprises three figures.

DETAILED DESCRIPTION OF INVENTION

Figure 1:
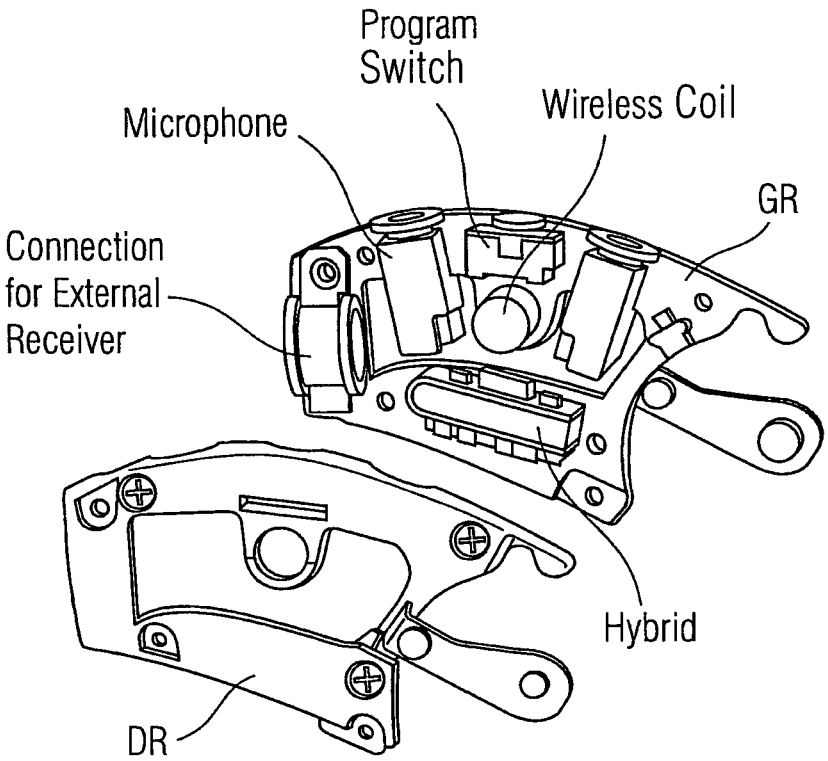
FIG. 1 shows the structure of an exemplary frame which consists of a basic frame GR (bottom frame) and a cover frame DR (top frame).

FIG. 1 shows the structure of an exemplary frame which consists of a basic frame GR (bottom frame) and a cover frame DR (top frame). The basic frame is embodied in such a way that it can hold all of the internal components (e.g. program switch, microphone, etc.).

The cover frame is embodied in such a way that it can be joined to the basic frame by means of pins, and after being joined forms, in combination with the basic frame, a stable frame over which the shells or the battery compartment are secured by means of pins.

Figure 2:
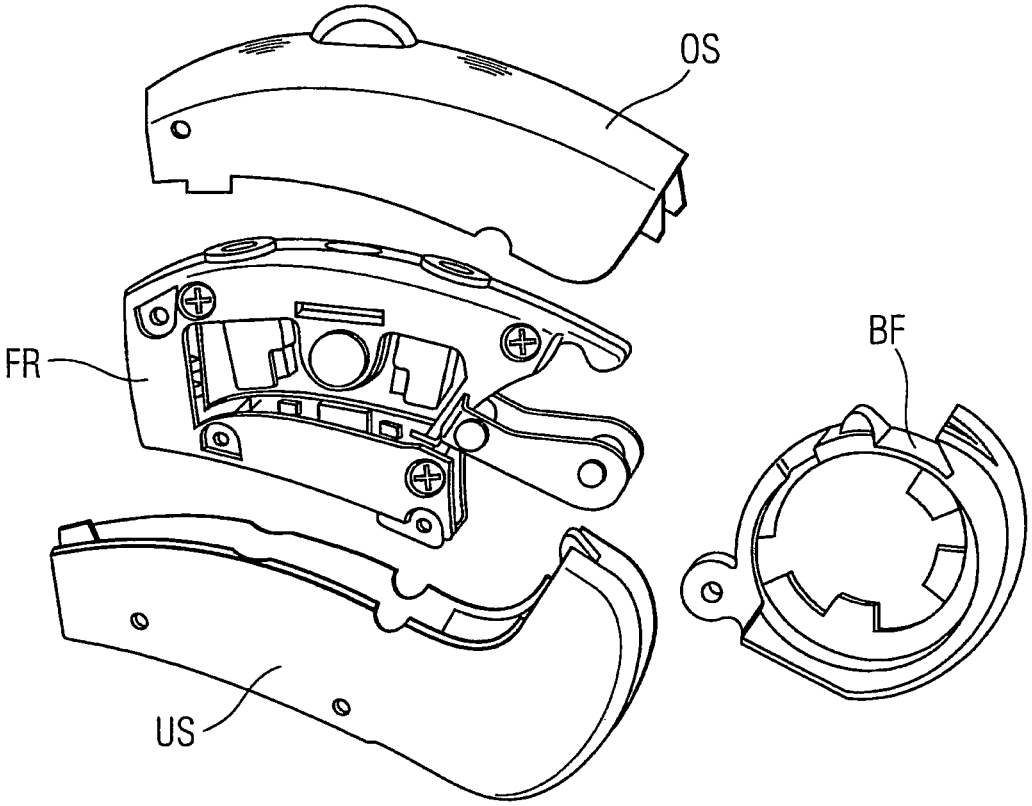
FIG. 2 shows an exemplary hearing device which comprises a frame FR, a top shell OS, a bottom shell US and a battery compartment BF.

FIG. 2 shows an exemplary hearing device which comprises a frame FR, a top shell OS, a bottom shell US and a battery compartment BF. In the case of the illustrated frame FR the basic frame GR is already joined to the cover frame DR.

Figure 3:
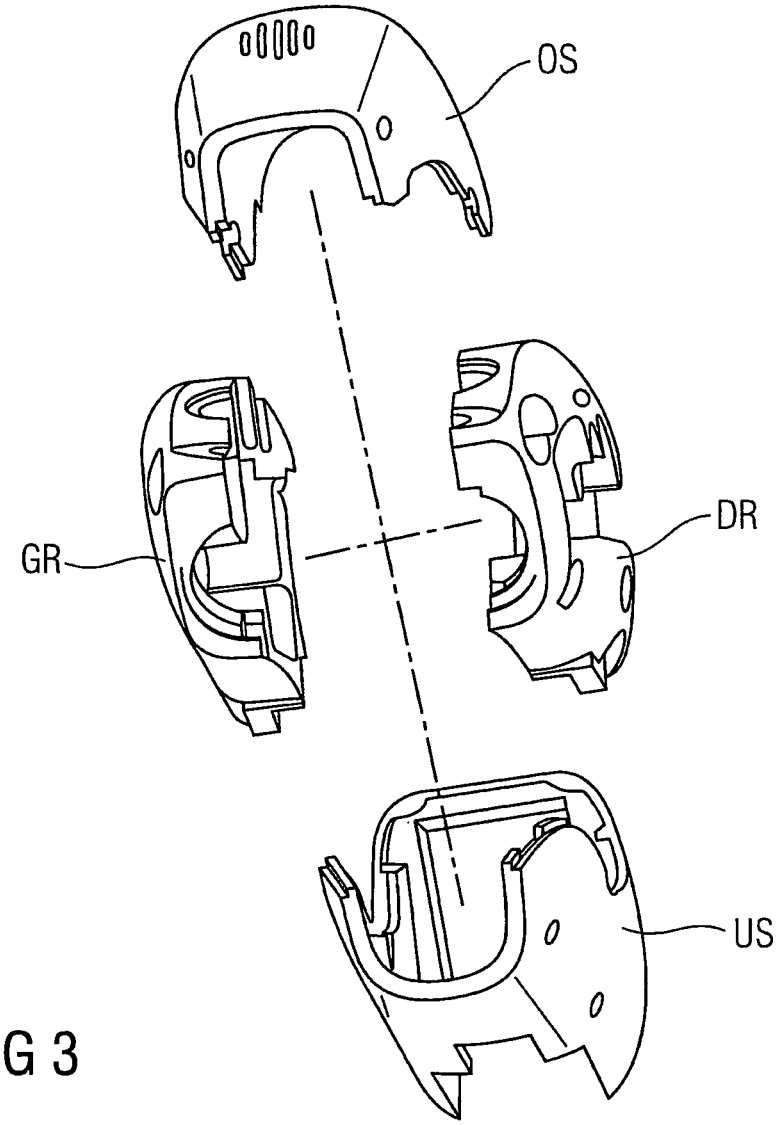
FIG. 3 shows an orthogonal and/or right-angled separation of the frame relative to the shell.

FIG. 3 shows an orthogonal and/or right-angled separation of the frame relative to the shell. The top or bottom shell is opened vertically, the basic or cover frame horizontally.

As a result of the cited separation, frame and housing mutually brace each other very well, thereby minimizing vibrations of the housing.

The invention claimed is:

1. A hearing device, comprising:

a frame consisting of a basic frame and a cover frame, and holding internal components of the hearing device; and a shell completely encasing said frame, said shell including an upper shell and a lower shell;

a battery compartment;

said upper shell, said lower shell, and said battery compartment being secured to said frame via pins;

said frame being separated orthogonally relative to said shell, so that said upper shell and said lower shell is opened vertically and said basic frame and said cover frame are opened horizontally.

2. The hearing device as claimed in claim 1, wherein the battery compartment is formed to hold a button style battery.

* * * * *